United States Patent [19]

Tilbor et al.

[11] 4,247,108

[45] Jan. 27, 1981

[54] TIME LIMITED POWER BOOST PASSING FOR TOY VEHICLES

[75] Inventors: Neil Tilbor, Freeport; William Rosenhagen, Ossining, both of N.Y.

[73] Assignee: Ideal Toy Corporation, Hollis, N.Y.

[21] Appl. No.: 74,172

[22] Filed: Sep. 10, 1979

[51] Int. Cl.[3] ..... A63F 9/14; A63H 18/12

[52] U.S. Cl. ..... 273/86 B; 46/262; 104/304; 318/68

[58] Field of Search ..... 273/86 B, 86 F; 46/262; 318/68; 104/304, 305

[56] References Cited

U.S. PATENT DOCUMENTS

| | | | |
|---|---|---|---|
| 1,999,052 | 4/1935 | Kennedy | 273/86 B |
| 3,432,167 | 3/1969 | Normandin | 273/86 F |
| 3,462,664 | 8/1969 | Lemon | 318/68 X |
| 4,078,799 | 3/1978 | Lahr | 273/86 B |

FOREIGN PATENT DOCUMENTS

| | | | |
|---|---|---|---|
| 503477 | 4/1939 | United Kingdom | 273/86 B |
| 634756 | 3/1950 | United Kingdom | 318/68 |

*Primary Examiner*—Anton O. Oechsle
*Attorney, Agent, or Firm*—Richard M. Rabkin

[57] ABSTRACT

A toy vehicle game includes an endless track defining two generally parallel lanes along which toy vehicles including reversible rotary drive motors responsive to current polarity reversal are driven while being biased against one or the other of the side walls of the track depending upon the polarity of current supplied to the vehicle motor. Current is supplied to the track through contact strips and a control system which permits the operators to separately and independently control current to the contact strips. When the polarity of the current to one of the toy vehicles is reversed a boost in available average electrical power is made available to that toy vehicle for a first limited duration maximum period. After using the boosted average power the selected toy vehicle must return to its original lane to be operated there at a normal power level for a mimimum of a second limited fixed duration period before power boost is again available. A balancing control equalizes the maximum performance of the two vehicles.

19 Claims, 14 Drawing Figures

TIME LIMITED POWER BOOST PASSING FOR TOY VEHICLES

BACKGROUND OF THE INVENTION

The present invention relates to a toy vehicle game and a control system therefor. More particularly the invention relates to a toy vehicle game in which at least two toy vehicles are separately controlled by the players to enable them to turn out from one lane to the other lane and pass other vehicles on the track. A single boost in maximum available electrical power is made available for a limited maximum time to the toy vehicle executing the passing maneuver.

With the ever increasing popularity of toy vehicle games, such as for example the well known "slot car" games, there is an increasing demand for more realistic action. To this end attempts have been made in the past to provide "slot car" type games with speed control systems, as for example by varying the current flow to the vehicles in the game. To further enhance such realism the slot arrangements in such games also provide for crossing the vehicles from one side of the track to another, to simulate an actual changing of lanes. However, the vehicle is in fact constrained to a fixed predetermined and unvariable path.

Since the play value of such previously proposed vehicle games is limited to the regulation of speed of travel, attempts have been made to provide toy vehicle games which enable an operator to control movement of the vehicle from one lane to the other without the constraint of a guide slot in the track. Such systems include for example the type shown in U.S. Pat. No. 3,797,404, wherein solenoid actuated bumpers are used to physically push the vehicle from one lane to the other by selectively engaging the bumpers along the side walls of the track. It is believed that this type of system does not insure movement of the vehicle from one lane to the other, particularly at slow speeds, and the bumper movements for pushing the vehicle are not realistic.

Other attempts to provide vehicle control for moving the vehicle from one lane to the other involves relatively complicated steering control mechanisms which respond to the switching on and off of current to the toy vehicle supplied through contact strips in the track surface. Such systems are disclosed for example in U.S. Pat. Nos. 3,774,340 and 3,837,286. However, in addition to the relative complexity of the steering arrangements the vehicles of course lose speed when the current supply is shut off, so that the vehicle slows down and the realistic effect desired to be produced is adversely affected.

Still other steering systems are provided in toy vehicles wherein the vehicle's steering is controlled in response to a reversal of the polarity of the current flow to the electrical drive motor in the vehicle. Such systems are disclosed for example in U.S. Pat. Nos. 3,453,970 and 3,813,812, which avoid the problem of stopping current flow completely to the motor so that there is little or no loss of speed, but their steering systems contain numerous moving parts which wear and require constant attention. In U.S. Pat. No. 3,453,970 to Hansen, electrical wires connecting the motor to the current collectors of the vehicle are used to aid in the steering operation and thus may well work loose during use of the vehicle. Another reversing polarity system is shown in U.S. Pat. No. 3,232,005 wherein the toy vehicle does not operate on a track and steering control is not provided for switching lanes, but rather is used to provide an apparently random travel control for the vehicle.

Still another toy vehicle game which has been suggested to avoid the constraints of slot car type systems is disclosed in U.S. Pat. No. 3,239,963 wherein a relatively complex steering control is provided which is responsive to the actuation of a solenoid mounted in the toy vehicle and is controlled remotely by the players.

Still another type of toy vehicle game is disclosed in U.S. Pat. Nos. 4,078,799 and 4,141,553 wherein a slotless track separately provides power to reversible electric motors in a pair of toy vehicles. Either one of two driving wheels on each toy vehicle is powered, depending on the setting of a control switch on an associated controller thus biasing the toy vehicle against one or the other of side walls defining the inner and outer perimeters of the slotless track. The electric motors in the two cars are independently reversed, and the lane travelled by the affected car is selected by the polarity of half-wave-rectified electric power fed to it from associated controller.

OBJECTS AND SUMMARY OF THE INVENTION

It is an object of the present invention to overcome the limitations of previous toy vehicle games wherein toy vehicles are permitted to turn out and move from one lane to the other without the restraint of a guide slot or the like.

Still another object of the present invention is to provide a toy vehicle which is adapted to move along a guide track and change from one lane to the other, under the control of a player.

A still further object of the present invention is to provide a toy vehicle game in which separate vehicles can be separately controlled by the players to move from one lane to the other and pass one another.

A further object of the present invention is to provide a control system for toy vehicles which enables the toy vehicles to turn out and pass one another along a guide track.

A still further object of the present invention is to provide a toy vehicle game in which a single limited-time boost in maximum available electrical power is made available to a toy vehicle performing a passing maneuver.

A still further object of the present invention is to provide a toy vehicle game in which a second limited time must elapse after the return of a toy vehicle to its original track following a passing maneuver before a further power boost is available during a subsequent passing maneuver.

A still further object of the present invention is to provide a toy vehicle game in which the maximum performance of two toy vehicles may be balanced whereby racing performance is more dependent on the skill of the operators.

A still further object of the present invention is to provide an improved toy vehicle game.

Another object of the present invention is to provide a toy vehicle game of the character described which is relatively simple in construction and durable in operation.

Yet another object of the present invention is to provide a toy vehicle game, as well as a control system therefor, which is relatively simple and economical to manufacture.

Accordingly, there is provided a toy vehicle system comprising a track having at least first and second vehicle lanes, at least one electrically driveable toy vehicle adapted for driving on the track, control means for controlling the amplitude of electric power to the at least one electrically driveable toy vehicle and for selectively providing the electric power in either first or second polarity, means for biasing the vehicle into the first vehicle lane in response to the first polarity and into the second vehicle lane in response to the second polarity and boost means for boosting the maximum power available to the at least one electrically driveable toy vehicle for a predetermined maximum time after changing the electric power from the first to the second polarity.

According to a feature of the invention, the toy vehicle further comprises means in the boost means for preventing the boosting until the second predetermined time after changing the electric power from the second to the first polarity.

According to a further feature of the invention, the toy vehicle system is provided comprising a track having at least first and second lanes, the track having means guiding and independently feeding electric power to first and second toy vehicles, control means for independently controlling the amplitude of electric power fed to the first and second toy vehicles and balancing means for equalizing the maximum performance of the first and second toy vehicles.

The power supply to the electrical motors of the vehicles is provided through electrical contact strips located in the lanes of the vehicle track. This power supply system is constructed to enable the operators to separately control the speed of the vehicles and also to separately reverse the polarity of current flow to the electrical motors of the vehicles, whereby the vehicles will change lanes. In addition the vehicles are provided with a relatively simple shock absorbing front end system which absorbs the impact of the vehicle against the side walls during a lane change and directs the front wheels of the vehicles in the desired path of travel.

The above, and other objects, features and advantages of this invention will be apparent in the following detailed description of illustrative embodiments thereof, which are to be read in connection with the accompanying drawings.

DETAILED DESCRIPTION OF THE PREFERRED EMBODIMENT

Figure 1:
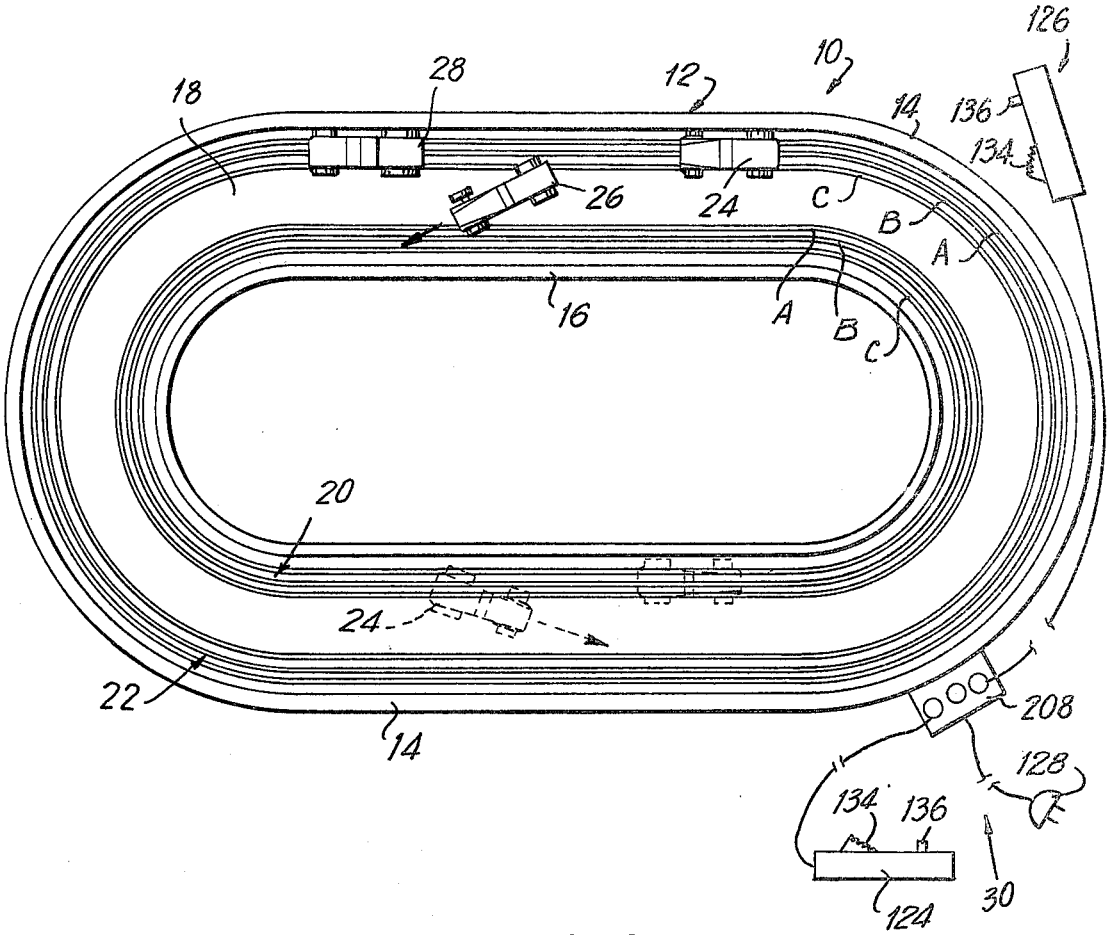
FIG. 1 is a plan view of a toy vehicle game constructed in accordance with the present invention.
Figure 2:
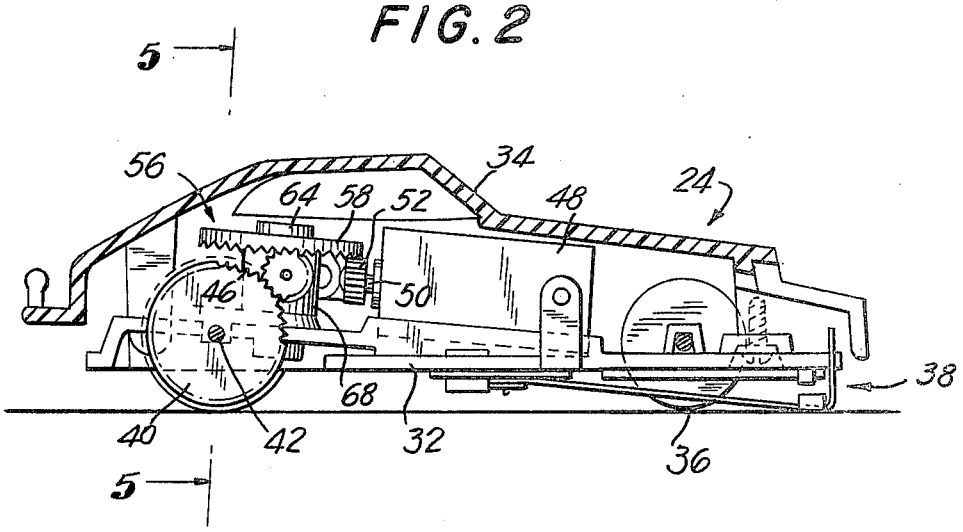
FIG. 2 is a longitudinal sectional view of the toy vehicle adapted for use with the game of FIG. 1.

Referring now to the drawings in detail, and initially to FIG. 1 thereof, the toy vehicle game 10, constructed in accordance with the present invention, includes an endless track 12 of any suitable non-conducting material such as plastic having a laterally spaced upstanding outer side wall 14 and inner side wall 16 defining the outer and inner perimeters respectively of a road bed or track surface 18 extending therebetween. The road bed 18 has a width sufficient to define at least an outer or normal vehicle lane 22 and an inner, or passing vehicle lane 20 thereon along which a plurality of toy vehicles 24 and 26 can be operated.

In the illustrative embodiment of the present invention the toy vehicle game includes operator controlled toy vehicles 24, 26 which may have the form of miniature cars, tracks, vans, etc and which are of substantially identical construction except for the arrangement of their current collectors as described hereinafter. In addition, a drone car 28, which moves along the track at a relatively constant speed may also be provided.

Toy vehicles 24, 26 are separately controlled by the players through a control system 30 including individual hand controllers 124 and 126 which enable the players to vary current supplied to the electrical motors in the vehicles, thereby to vary the vehicle speed. Hand controllers 124 and 126 also enable the players to change the polarity of current supplied to the respective vehicle motors, whereby the vehicles can be switched by the players from one lane to the other. Drone car 28 on the other hand moves along the vehicle track at a constant speed providing an obstacle along the track which player controlled toy vehicles 24, 26 must pass. The front wheels of the drone car are preferably canted in one direction or the other so that the drone car is normally driven along either the inner or the outer lane depending on the direction in which the front wheels are canted. Drone car 28 includes an electric motor operated by a battery contained within it and connected through a direct drive transmission of any convenient construction to the rear wheels thereof.

Toy vehicle 24 is illustrated in detail in FIGS. 2-6. As seen therein toy vehicle 24 includes a frame or chassis 32 of any convenient construction, and a removable body or shell 34 which may be snap fit on frame 32 in any convenient manner. A pair of front wheels 36 are rotatably mounted on frame 32 through a shock absorbing front end system 38, described more fully hereinafter, while rear drive wheels 40 are rotatably mounted for independent rotation on a shaft or axle 42 mounted in frame 32 (See FIG. 5). One of rear drive wheels 40 may be fixed on shaft 42 by a spline 44 or the like, while the other of the wheels may be freely rotatably mounted on shaft 42. Alternatively both rear drive wheels 40 may be freely rotatably mounted on shaft or axle 42. With either arrangement the rear drive wheels 40 can be separately and independently driven.

Each of rear drive wheels 40 is formed from any suitable material such as plastic material or cast metal and has on its inner side a spur gear 46 integrally formed thereon or attached thereto by which rotary power is supplied to the respective rear drive wheel 40.

The power for driving toy vehicle 24 or 26 is supplied from a D.C. electric motor 48 mounted on frame 32 in any convenient manner. Electric motor 48 is of conventional D.C. construction and includes a rotary output member or shaft 50 connected to the rotor of electric motor 48 in the usual manner. In the embodiment illustrated in FIG. 2, a pinion 52 is secured to shaft 50 for rotation thereby. Pinion 52 is drivingly engaged with a transmission system 56 which is responsive to the direction of rotation (i.e. the direction of rotation of output shaft 50 of electric motor 48, which results from the polarity of current supplied to the motor) to selectively drive one or the other of rear drive wheels 40.

Figure 4:
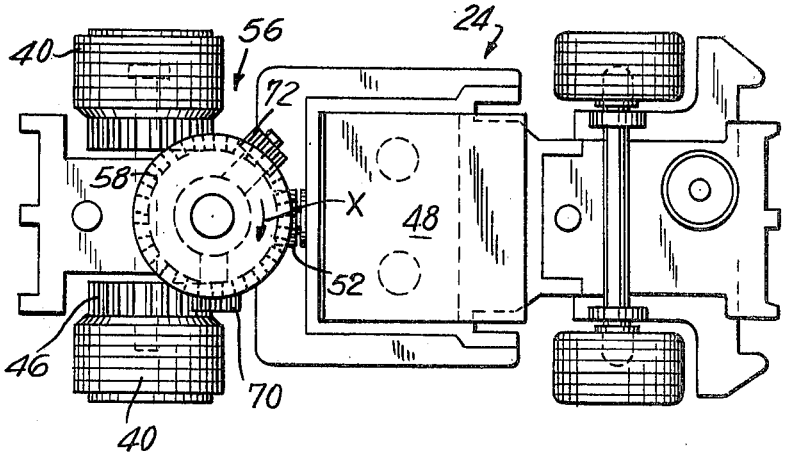
FIG. 4 is a top plan view of the toy vehicle shown in FIG. 2, with the body removed.
Figure 5:
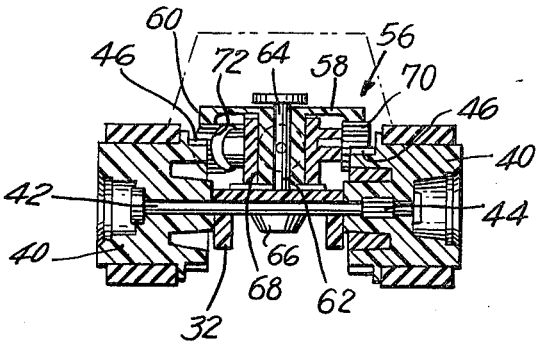
FIG. 5 is a sectional view taken along line 5—5 of FIG. 2.
Figure 6:
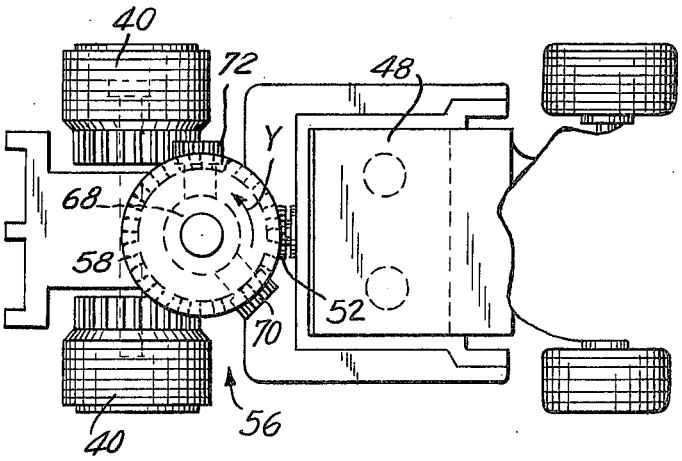
FIG. 6 is a top plan view, similar to FIG. 4, showing another position of the drive transmission of the vehicle.

In the embodiment illustrated in FIGS. 2 and 4–6, transmission system 56 includes a crown gear 58 having a central collar 62 and downwardly extending teeth 60 in constant mesh with pinion 52. A mounting pin 64 extends through central collar 62 and is secured at its lower end 66 in frame 32 so that crown gear 58 is freely rotatably mounted thereon. A moveable transmission element including a sleeve or gear support member 68 is rotatably mounted on central collar 62. A pair of idler gears 70, 72 are in turn rotatably mounted on sleeve 68 for rotation about axes extending generally perpendicular to the axis of rotation of crown gear 58. Idler gears 70, 72 are positioned at an angle to each other (see FIGS. 4 and 6) both in constant engagement with crown gear 58. As a result, when electric motor 48 is operated crown gear 58 due to its engagement with pinion 52, is rotated in either a clockwise or counterclockwise direction as seen in FIGS. 4 and 6, depending upon the polarity of the current supplied to electric motor 48. At the same time idler gears 70, 72 are continuously rotated by crown gear 58. However, because idler gears 70, 72 are mounted on rotatable sleeve 68, the engagement between crown gear 58 and idler gears 70, 72 causes sleeve 68, and thus idler gears 70, 72 to rotate axially about mounting pin 64 and central collar 62 in a clockwise or counterclockwise direction according to the direction of rotation of crown gear 58. As a result, as seen in FIG. 4, when crown gear 58 is rotated in a clockwise direction indicated by arrow X, idler gears 70, 72 are also moved in a clockwise direction so that idler gear 70 engages spur gear 46 of the lower wheel 40 in the vehicle shown in FIG. 4. Thus the right drive wheel 40 of the toy vehicle is driven while the left drive wheel is free to rotate.

In the toy vehicle game illustrated in FIG. 1, when toy vehicle 26 is in the outside lane adjacent outer side wall 14 and power is supplied to its right rear drive wheel 40 in the manner described above, toy vehicle 26 is moved from outer vehicle lane 22 to inner or passing vehicle lane 20 as illustrated in FIG. 1. When the front end of toy vehicle 26 engages the inner side wall 16 of track 12, the continued drive of its right rear drive wheel 40 biases toy vehicle 26 to move along inner side wall 16 in inner vehicle lane 20 of track 12. Of course, if toy vehicle 26 is moving at a relatively high speed as it goes about a curve in track 12, it may be propelled by centrifugal force into outer vehicle lane 22. However, if the drive to the right hand rear drive wheel 40 is maintained toy vehicle 26 again moves inwardly to inner vehicle lane 20 as previously described.

When the polarity of current supplied to electric motor 48 is reversed, the direction of rotation of crown gear 58 also is reversed to produce rotation thereof in the counterclockwise direction, as illustrated by Y in FIG. 6. Idler gears 70, 72 are rotated in the opposite direction and sleeve 68 is rotated in the same direction as crown gear 58. Idler gear 72 engages spur gear 46 of left rear drive wheel 40 (i.e. the upper rear drive wheel 40 in FIG. 6) so that this wheel is driven while the right rear drive wheel is free to rotate When the left rear drive wheel 40 of the toy vehicle is driven in this manner, a bias is applied to the toy vehicle which causes it to move to the right. Thus, as illustrated in FIG. 1 by toy vehicle 24 shown in dashed lines, when toy vehicle 24 is in inner vehicle lane 20 of track 12 and the polarity of the current to electric motor 48 is reversed so that its left rear drive wheel 40 is driven, toy vehicle 24 is biased toward outer vehicle lane 22. When the front end of toy vehicle 24 contacts outer side wall 14, it continues to move along outer side wall 14 in outer vehicle lane 22 until the polarity of current supplied to electric motor 48 is again reversed. In this regard it is noted that because of the arrangement of pinion 52, crown gear 58, and idler gears 70 and 72, the vehicle is always propelled in a forward direction regardless of the direction of rotation of pinion 52 of electric motor 48.

Figure 8:
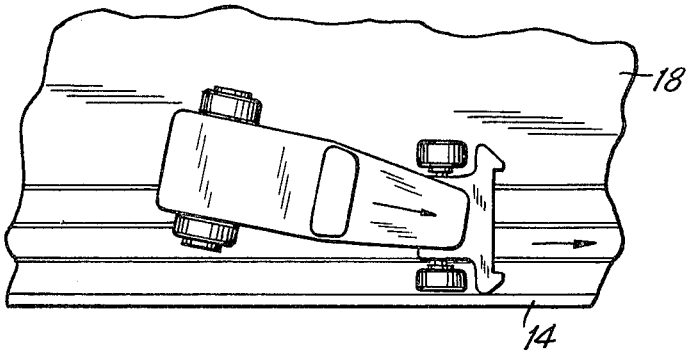
FIG. 8 is an enlarged view illustrating the impact of a vehicle against one of the side walls of the track during a lane change.

As mentioned, toy vehicles 24 and 26 include shock absorbing front end system 38. In the embodiment illustrated in FIG. 3 shock absorbing front end system 38 includes a wheel support plate 152 pivotally mounted on a pivot pin 154 or the like on frame 32. Wheel support plate 152 includes bosses 156 of any convenient form which rotatably mount a shaft 158 on which front wheels 138 of the toy vehicle are secured. Wheel support plate 152 is held in its centered position, so that front wheels 138 normally direct the toy vehicle in a straight line, by a spring arrangement 140 which includes an integral tongue 142 formed with wheel support plate 152. Tongue 142 is captured between a pair of posts or abutment members 144 formed in frame 32. By this arrangement, wheel support plate 152 and thus front wheels 138 are resiliently held in their centered position. However, when the toy vehicle changes lanes and impacts against one of the side walls (for example outer wall 14, shown in FIG. 8), wheel support plate 152 pivots in response to that impact and the shock of that impact is absorbed by tongue 142. At the same time the pivotal movement of wheel support plate 152 turns front wheels 138 therewith and directs them along the desired path, thereby insuring that the toy vehicle moves into alignment with the contact strips of track 12, as quickly as possible. To assist in the shock absorbing feature of the invention, wheel support plate 152 is provided with enlarged bumper elements 146 which extend outwardly beyond the vehicle so that bumper elements 146 engage the side wall of the track before any other portion of the toy.

Figure 3:
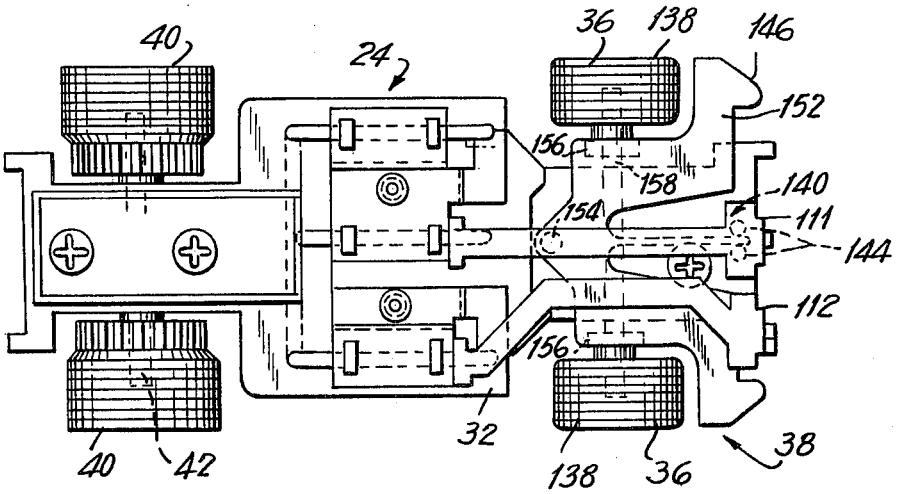
FIG. 3 is a bottom view of one of the toy vehicles illustrated in FIG. 1.
Figure 3A:
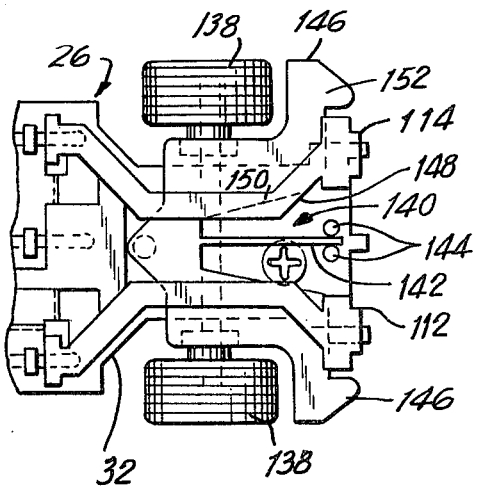
FIG. 3A is a bottom view of the front end portion of a second vehicle used in the game of FIG. 1.

As seen in FIG. 3A tongue 142 is defined between slots 148 formed in wheel support plate 152 on opposite sides of tongue 142. Slots 148 have outer edges 150 which engage posts 144 in the event wheel support plate 152 is pivoted a sufficient distance. The engagement of the outer edges 150 of slots 148 against posts 144 limit the pivotal movement of wheel support plate 152 beyond a predetermined maximum position.

In order to supply current to toy vehicles 24 and 26, track surface 18 is provided with a plurality of electrical contact strips in each of lanes 20, 22. In the illustrative embodiment of the invention, each lane is provided with three contact strips A, B, and C respectively. Contact strips A, B, and C are formed of an electrically conductive metallic material and are embedded in track surface 18 so that they are substantially flush with track surface 18 and present no obstacle to movement of toy vehicles 24 and 25 from one lane to the other. Current is supplied to these strips, as described hereinafter, and is collected by current collectors mounted in predetermined locations on frame 32 of toy vehicles 24 and 26.

In accordance with the present invention, contact strips A, B, and C in each lane are paired with each other, i.e. the A contact strip in one lane is electrically connected to the A contact strip in the other lane, the B contact strips are connected to each other and the C contact strips are connected to each other. The C contact strips are connected to electrical ground and the A and B contact strips are provided to separately supply current and to control the polarity of the current to the respective vehicles, so that two toy vehicles 24 and 26 can operate in the same lane and still be separately controlled. For this reason, the current collector and the vehicles are arranged to associate the respective vehicles with only one of the pairs of contact strips. For example, vehicle 24 obtains current from contact strips B and C, while vehicle 26 obtains current only from contact strips A and C.

As illustrated in FIG. 3, toy vehicle 24 is provided with two current collectors 111, 112 with current collector 112 thereof positioned to contact ground strip C. Similarly, toy vehicle 26, illustrated in FIG. 3A, has current collectors 112, 114 mounted thereon with current collector 112 located in the same position as the corresponding collector of vehicle 24 for also contacting the ground contact strip C. These current collectors are mounted on toy vehicles in any convenient manner known in the art and are electrically connected in a known manner to electric motor 48 of their respective toy vehicles 24 and 26. Current collector 111 of vehicle 24 is mounted on the vehicle to engage contact strips B regardless of which lane toy vehicle 24 is in. As seen in FIG. 3, this current collector is located centrally of frame 32. Current collector 114 of toy vehicle 26 is located off center from the center line of frame 32 and in spaced relation to its associated current collector 112. Current collector 114 of toy vehicle 26 is positioned to engage contact strips A regardless of the lane in which the vehicle is moving. By this arrangement, each of the operators can separately control current supply and polarity to contact strips A, B to independently control toy vehicles 24, 26 respectively, regardless of the lane occupied by toy vehicles 24 and 26.

Figure 7:
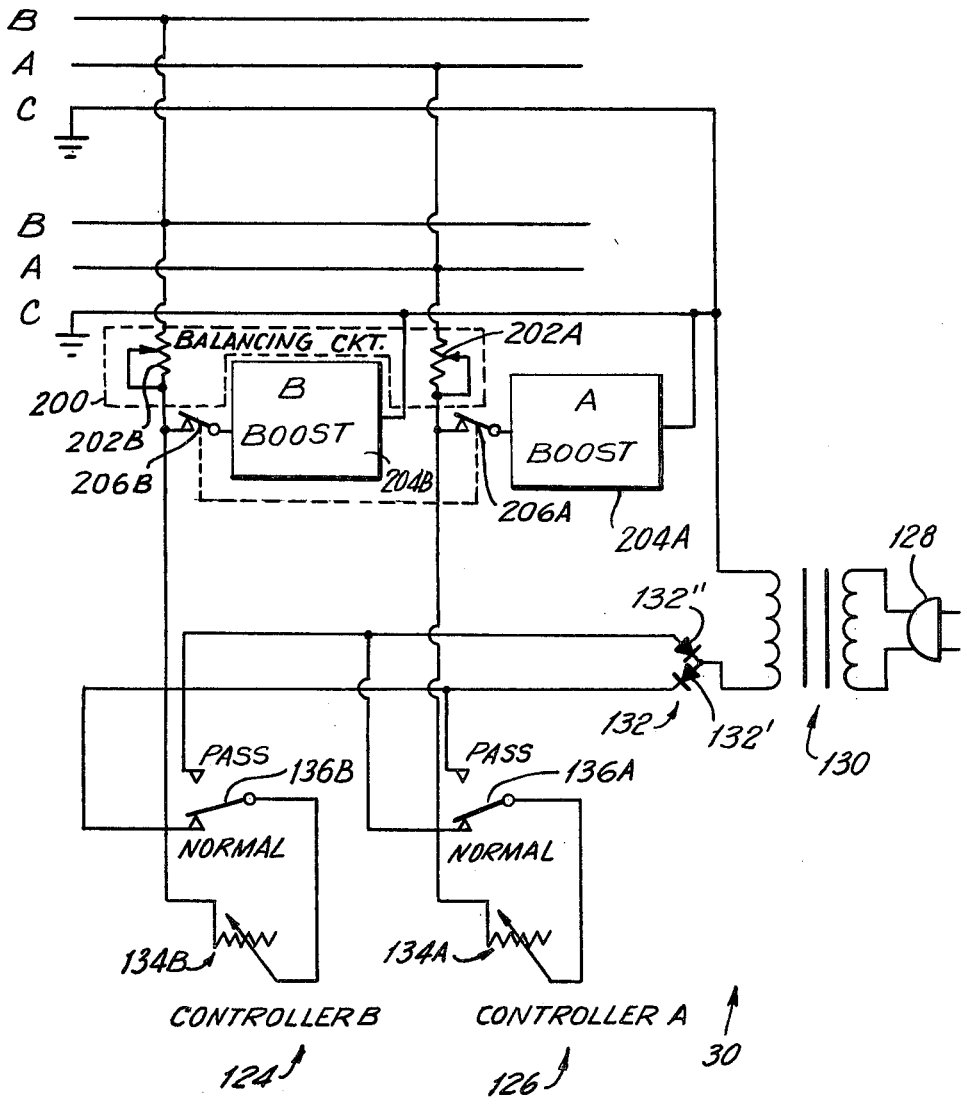
FIG. 7 is a schematic diagram of an electrical control system for the toy vehicle game of FIG. 1.

Control system 30 for the toy vehicle game illustrated in FIG. 1 is shown schematically in FIG. 7. control system 30 includes a B hand controller 124 and an A hand controller 126 by which the players can control toy vehicles 24, 26 respectively.

Control system 30 includes an electric plug 128 by which the system can be connected to an electrical AC power source, and a transformer 130. Power is supplied from transformer 130 through two oppositely polarized diodes 132' and 132" of a halfwave rectifier 132 to separately supply both positive half cycles and negative half cycles of rectified voltage to control switches 136B and 136A in hand controllers 124 and 126 respectively. Each hand controller may be provided as a hand held unit and include a variable resistor 134A and 134B, operated by a trigger on the unit. Current from B hand controller 124 is supplied through its variable resistor 134B and a balancing variable resistor 202B in a balancing circuit 202 to contact strips B. Current from A hand controller 126 is supplied through variable resistor 134A and a balancing variable resistor 202A in balancing circuit 202 to contact strips A. Variable resistors 134A and 134B may be of any convenient construction to permit the operators to vary the current supplied to their respective contact strips, A and B, and thus their respective toy vehicles 26 and 24 in order to vary the speed of the toy vehicles.

The polarity of the current supplied to toy vehicles 24 and 26 and their electric motors 48 is separately and independently controlled by A and B control switches 136A and 136B respectively. By this arrangement each player, using his hand controller 124 and 126 can control the speed of his toy vehicle 26 and 24 along track 12 and can also selectably position his toy vehicle in vehicle lane 20 or 22 simply by changing the polarity of current supplied to the toy vehicle. As described above the polarity of the current supplied to electric motor 48 of the respective toy vehicles 24 and 26 determines which of the two rear drive wheels 40 is powered, and thus determines which vehicle lane 20 or 22 the vehicle will be driven to.

In order to balance the load on transformer 130, the motors in the two toy vehicles are connected so that one of them is normally driven using the positive half cycles from diode 132' and the other is normally driven using the negative half cycles from diode 132". Alternatively, both vehicles may normally be driven with the same polarity. Control switches 136A and 136B are shown in their normal positions wherein the moveable contact of control switch 136A is in contact with its fixed contact which receives the negative half cycles of voltage from diode 132" and the moveable contact of control switch 136B is in contact with its fixed contact which receives the position half cycles of voltage from diode 132'. Thus the operation of A variable resistor 134A in A controller 126 normally applies negative half cycles of variable amplitude to contact strip A and B variable resistor 134 in B controller 124 normally applies positive half cycles of variable amplitude to contact strip B.

As illustrated in FIG. 1, when it is desired to switch a vehicle from the outer vehicle lane 22 to the inner vehicle lane 20, as shown with vehicle 26, the polarity of current supplied to toy vehicle 26 is selected to drive the outer of right rear drive wheel 40 of the toy vehicle thereby moving the toy vehicle leftwardly into inner vehicle lane 20. Likewise, when it is desired to move the vehicle outwardly the inner or left rear drive wheel 40 of the toy vehicle is driven, by properly selecting the polarity of current supplied to electric motor 48 of the toy vehicle, so that the toy vehicle moves toward the right and into outer vehicle lane 22. Thus the operators have complete control over both the speed of the vehicle and the lane in which the vehicle moves.

Balancing circuit 200 permits balancing the performance of two toy vehicles 24 and 26 to have approximately equal performance. This may be accomplished by the user by operating both toy vehicles 24 and 26 at, for example, maximum speed, and adding resistance in the line to either contact strip A of contact strip B using balancing variable resistor 202A or 202B as appropriate until both toy vehicles 24 and 26 run at substantially the same speed. In this way, inevitable performance differences in toy vehicles 24 and 26 arising from normal manufacturing tolerances are compensated and the outcome of a race between toy vehicles 24 and 26 becomes more a test of skill of the operators rather than being almost wholly determined by the speed superiority of one of toy vehicles 24 or 26. Balancing variable resistors 202A and 202B may be located in any convenient location such as in hand controllers 126 and 124 respectively, in a separate control box 208 or on track 12. In addition, balancing variable resistors 202A and 202B may be made readily accessible to adjustment such as by providing externally manipulable control knobs or they can be made less accessible to adjustment such as by providing only screwdriver adjustment therefor. Further, balancing variable resistors 202A and 202B may be made inaccessible to adjustment by locating them inside a suitable sealed enclosure. In addition, balancing variable resistors 202A and 202B may be ganged whereby increasing the resistance of one thereof decreases the resistance of the other to achieve equality of performance of toy vehicles 24 and 26 with a single control manipulation.

Although balancing resistors 202A and 202B are both shown as variable resistors, it would be clear to one skilled in the art that one of the balancing resistors may be a fixed resistor of intermediate resistance value and that a single variable resistor may be employed for balancing.

An A boost circuit 204A is connected through an A boost defeat switch 206A between contact strips A and C. Similarly, a B boost circuit 204B is connected through a B boost defeat switch 206B between contact strips B and C. Boost defeat switches 206A and 206B are preferably mechanically ganged as shown by the dashed line joining their movable contacts. When boost defeat switches 206A and 206B are placed in their open positions, boost is not provided.

When boost defeat switches 206A and 206B are in their closed positions shown in FIG. 7, when, for example, A control switch 136A is changed from its NORMAL position to its PASS position, a reversal in polarity of the halfwave rectifier power fed to contact strip A not only causes the toy vehicle controlled by contact strip A to change lanes, but also, A boost circuit 204A provides an increase in the average power fed to contact strip A for a fixed maximum period of, for example, 1.5 seconds, and then becomes ineffective to produce further boost as long as A control switch 136A remains in the PASS position. Furthermore, A boost circuit 204A is ineffective to produce further boost until after A control switch 136A is placed in its NORMAL position shown in FIG. 7 and is maintained in that position for a minimum additional time such as, for example, 1.5 seconds. At the end of this additional time another boosted passing cycle can be executed by again placing A control switch 136A in its PASS position.

B boost circuit 204B and B control switch 136B cooperate in a similar manner to produce a limited-time boost in the average power supplied to contact strip B.

When a drone car 28 having a constant speed slower than the desired speeds of toy vehicles 24 and 26 is utilized, an obstacle is provided in the outer lane of track 12 which the players must pass in order to continue moving along the track. This enhances the play value of the game as all players must pass the drone car during the game at some stage of operation of the game, and this introduces a further variable factor into the game requiring an additional degree of skill and vehicle control in order to win the "race".

A boost circuit 204A and B boost circuit 204B are identical except for the location of the input point for their associated boost defeat switches 206A and 206B respectively. Therefore, only A boost circuit 204A is described in detail.

Figure 9:
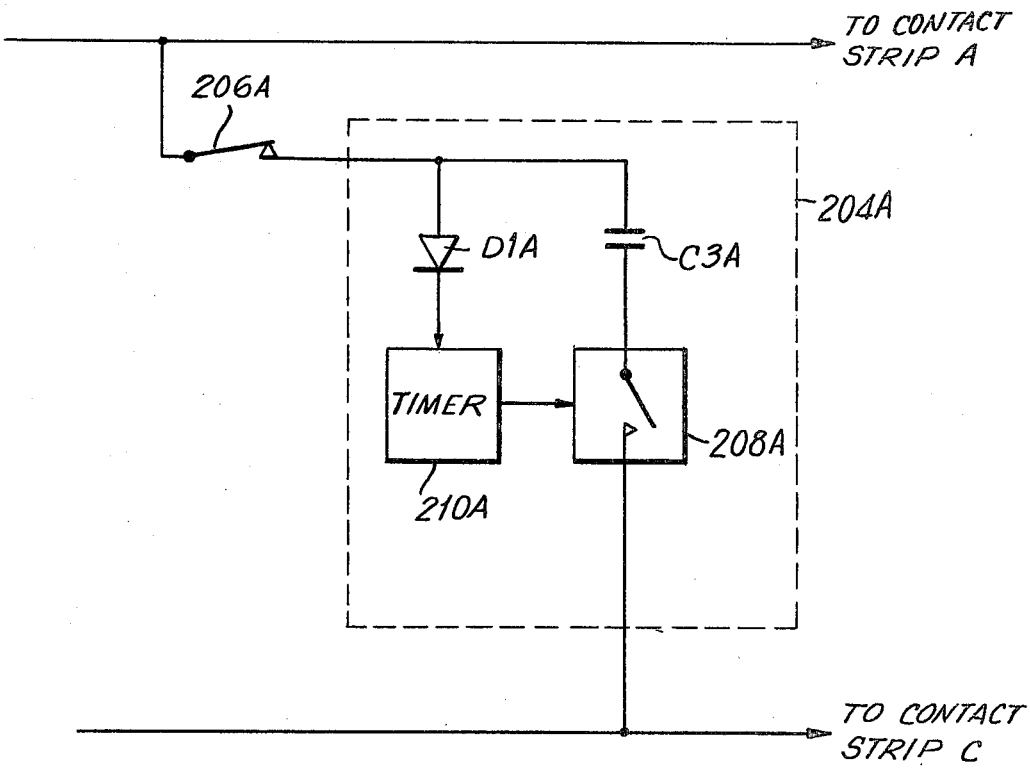
FIG. 9 is a simplified schematic diagram of the A boost circuit shown as a block in FIG. 7.

Referring now to the simplified diagram of A boost circuit 204A shown in FIG. 9, negative half cycles of voltage are normally fed to contact strip A and through A boost defeat switch 206A to the input of A boost circuit 204A. A large value capacitor C3A is connected in series with a normally open electronic switch 208A, represented as a mechanical switch for ease of explanation, between A boost defeat switch 206A and the line to contact strip C. An input diode D1A has its anode connected to A boost defeat switch 206A and its cathode connected to an input of a timer 210A. Timer 210A provides control signals to electronic switch 208A as will be explained.

Input diode D1A is polarized to block the normal negative half cycles at its anode terminal. Thus timer 210A maintains electronic switch 208A in the open condition shown. In this condition, A boost circuit 204A has no effect.

Figure 10:
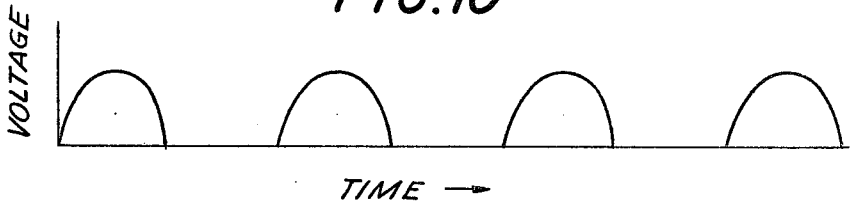
FIGS. 10 and 11 are waveform diagrams to which reference will be made in explaining the operation of the A boost circuit of FIG. 9.

When A control switch 136A (FIG. 7) is changed from its NORMAL to its PASS position, positive half cycles of voltage are provided therethrough from diode 132'. If A boost defeat switch 206A is open, positive half cycles of voltage, such as shown in FIG. 10, are provided to contact strip A. As previously explained, this polarity reversal reverses electric motor 48 and tends to bias the associated toy vehicle toward inner vehicle lane 20 at a speed substantially the same as produced by negative half cycles previously fed to the toy vehicle.

Figure 11:
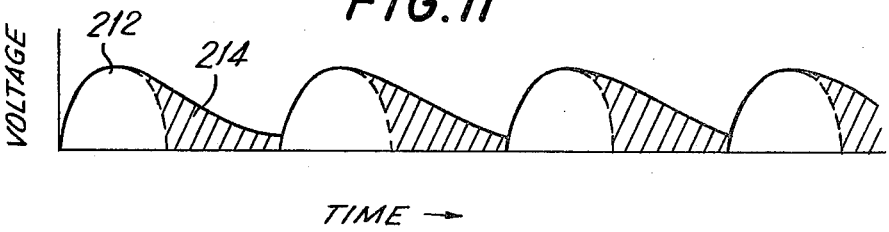

When A boost defeat switch 206A (FIG. 9) is closed, the positive half cycles of voltage are fed through input diode D1A to timer 210A. Timer 210A couples a control signal to electronic switch 208A which closes electronic switch 208A for a limited maximum time, suitably about 1.5 seconds, and then reopens electronic switch 208A. While electronic switch 208A is closed, capacitor C3A is shunted across contact strips A and C. Thus, capacitor C3A charges while the positive half cycles are fed to the associated toy vehicle and then discharges into the line during the intervening period. This effect is illustrated in FIG. 11. The positive half cycles 212 from the supply are augmented by an additional voltage 214, shown cross hatched, which is provided by capacitor C3A. It will be clear to one skilled in the art that the average voltage, or power, in the resultant signal consisting of the sum of the positive half cycles 212 and the additional voltage 214 exceeds the average voltage, or power, in the positive half cycles 212 alone. Consequently, while electronic switch 208A is closed, a power boost is provided to the associated toy vehicle. When electronic switch 208A is opened by timer 210A at the end of the timing cycle, the additional voltage 214 is no longer provided. The toy vehicle continues to be driven in the passing lane by the positive half cycles (FIG. 10) but at its normal unboosted speed. When A control switch 136A (FIG. 7) is returned to the NORMAL position, the toy vehicle is biased into the outer vehicle lane 22 by the resulting negative half cycles supplied thereto as previously described. If A control switch 136A is immediately returned to the PASS position, timer 210A (FIG. 9) prevents closing of electronic switch 208A and thus only normal, unboosted power is available to the associated toy vehicle. A minimum time, suitably about 1.5 seconds, must be permitted to elapse after placing A control switch 136a in the NORMAL position before a power boost is again available upon returning A control switch 136A to the PASS position.

Figure 12:
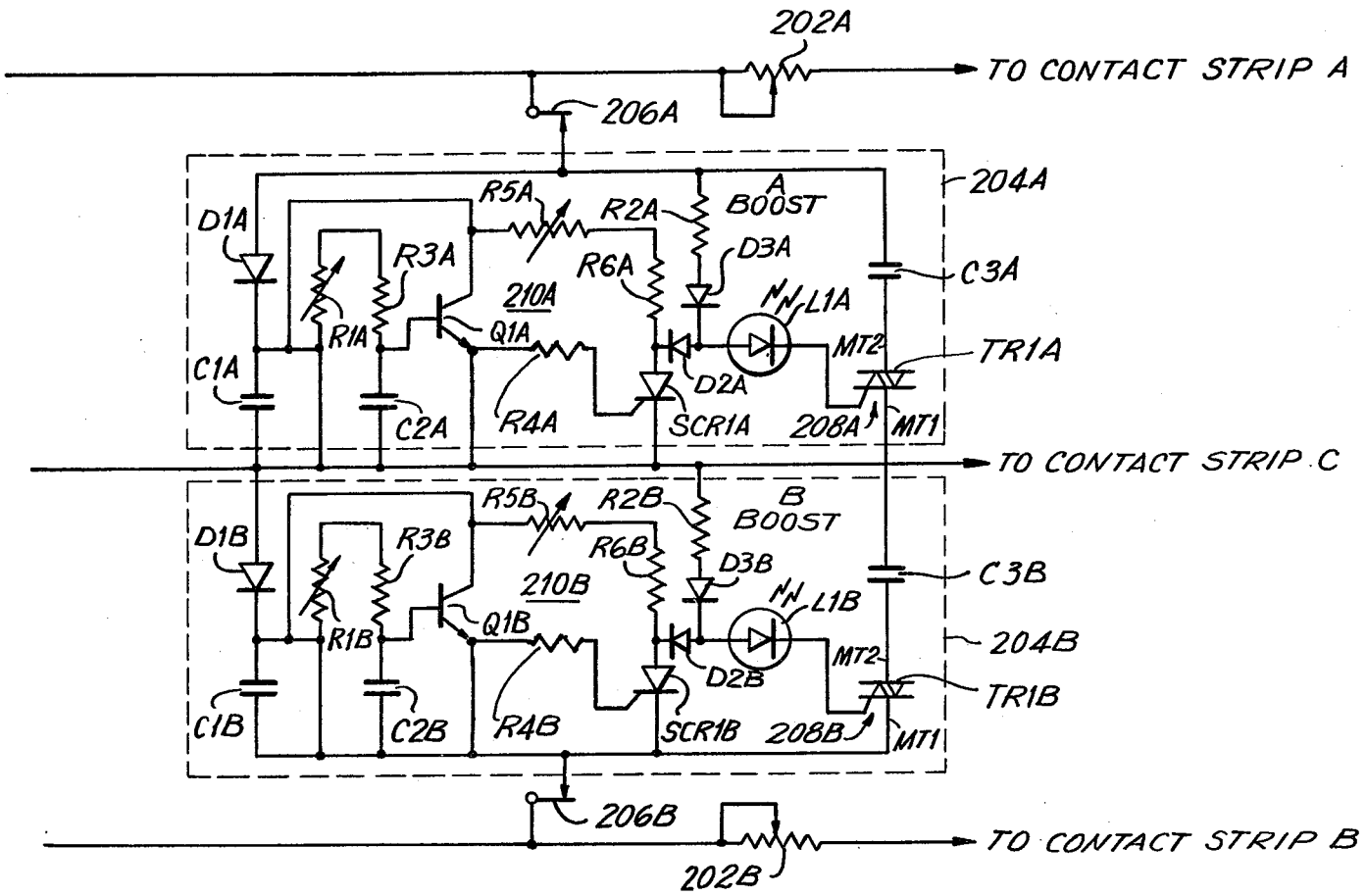
FIG. 12 is a detailed schematic diagram of the A boost circuit of FIGS. 7 and 9.

Referring now to the detailed schematic diagram in FIG. 12, electronic switch 210A is seen to be a triac TR1A having two main terminals MT2, MT1 in series with capacitor C3A between A boost defeat switch 206A and the line to contact strip C. Input diode D1A is also seen connected to A boost defeat switch 206A. The remaining contents of A boost circuit 204A make up timer 210A.

When A boost defeat switch 206A is open, or when only negative half cycles of voltage are available at the anode terminal of diode D1A, transistor Q1A, silicon controlled rectifier SCR1A, light emitting diode L1A, and traic TR1A are all in the OFF, or deenergized, condition. Smoothing capacitor C1A and timing capacitor C2A are both initially discharged. When positive pulses are fed to the anode terminal of diode D1A, smoothing capacitor C1A is almost immediately charged to the peak voltage of the positive half cycles. The voltage in smoothing capacitor C1A begins charging timing capacitor C2A through variable resistor R1A and fixed resistor R3A. In addition, the voltage in smoothing capacitor C1A is coupled to the collector of transistor Q1A and through variable resistor R5A in series with resistor R6A to the cathode terminal of a gate diode D2A. The anode terminal of gate diode D2A is connected to the anode terminal of a light emitting diode L1A and to the cathode terminal of a gate diode D3A whose anode terminal is connected through a resistor R2A to the terminal of A boost defeat switch 206A. Since smoothing capacitor C1A is charged to the peak voltage of the positive half cycles and SCR1A is initially off, substantially this full peak value is fed to the cathode terminal of gate diode D2A. This back biases gate diode D2A and permits light emitting diode L1A to be thereby forward biased through resistor R2A and gate diode D3A and feed a positive control voltage to the gate terminal of triac TR1A. Triac TR1A is thereby turned ON and shunts capacitor C3A across the lines to contact strips A and C as previously described. Light emitting diode L1A is illuminated to indicate that a power boost is being supplied.

When timing capacitor C2A becomes charged up to a predetermined voltage, about 0.7 volts, transistor Q1A is turned ON or made conductive and the positive voltage at its collector is coupled through a low resistance path to its emitter. The positive voltage at the emitter of transistor Q1A is applied through resistor R4A to the gate of silicon controlled rectifier SCR1A. Silicon controlled rectifier SCR1A is thereby turned ON and reduces the voltage at the cathode terminal of gate diode D2A to zero. Thus gate diode D2A is forward biased and shunts the voltage previously available at light emitting diode L1A to ground thus extinguishing light emitting diode L1A and and removing the gate signal from the gate terminal of triac TR1A. Timing capacitor C2A continues to charge toward the peak of voltage pulses from input diode D1A. Triac TR1A is thereby turned OFF and the boost provided by capacitor C3A is no longer available. Variable resistor R1A may be adjusted to control the charging rate of timing capacitor C2A and thus the time that triac TR1A is turned OFF. A period of about 1.5 seconds has been found satisfactory for this purpose. As long as positive pulses continue to be delivered to diode D1A, the condition described in the preceding remains constant with the triac TR1A and light emitting diode L1A turned OFF and silicon controlled rectifier SCR1A and transistor Q1A turned ON.

When A boost defeat switch 206A is opened or when negative half cycles are again applied to input diode D1A, the voltages stored in smoothing capacitor C1A and timing capacitor C2A begin discharging through resistors R3A, R1A, R5A, R6A, and silicon controlled rectifier SCR1A. As long as the voltage fed to SCR1A from capacitors C1A and C2A is sufficient to maintain forward conduction, SCR1A continues to conduct regardless the condition at its gate. If positive pulses are again applied to input diode D1A while the voltages stored in capacitors C1A, C2A and silicon controlled rectified SCR1A remains ON and light emitting diode L1A and triac TR1A remain OFF, smoothing capacitor C1A immediately takes on a full charge and thus forces a further delay before boost is again available. It is only after a sufficient time for the voltages in timing capacitor C2A and smoothing capacitor C1A to be discharged to a value which permits SCR1A to turn OFF, that a further power boost is available from A boost circuit 204A.

B boost circuit 204B is identical to A boost circuit 204A except that input diode D1B and capacitor C3B are directly connected to the line to contact strip C and B boost defeat switch 206B is connected to the negative side of the circuit. This accommodates the fact that the normal pulses to contact strip B are positive pulses and the boost is obtained when negative pulses are provided to contact strip B and to B boost circuit 204B.

The following parts are suitable in the embodiment of FIG. 9:

PARTS LIST FOR FIG. 9

| RESISTORS (OHMS) | CAPACITORS (MICROFARADS) |
|---|---|
| R1A, R1B - 50K variable | C1A, C1B - 220 |
| R2A, R2B - 2.2K | C2A. C2B - 47 |
| R3A, R3B - 47K | C3A, C3B - 1000 |
| R4A, R4B - 10K | DIODES |
| R5A, R5B - 5K variable | D1A, D1B - IN4001 |
| R6A, R6B - 1K | D2A, D2B - IN4001 |
| TRIAC | D3A, D3B - IN4001 |
| TR1A, TR1B - 2N 6068 A | SILICON CONTROLLED RECTIFIER |
| LIGHT EMITTING DIODE | |
| L1A, L1B - any type suitable for voltage | SCR1A, SCR1B - MCR 107-2 |

As previously noted, after the voltage in timing capacitor C2A reaches 0.7 volts and causes triac TR1A to be turned OFF, timing capacitor C2A continues to charge toward the peak voltage of the positive half cycles. Thus for some time after triac TR1A is turned OFF, the voltage in timing capacitor C2A continues to change. When switch 136A is returned to the NORMAL position, the time required for the voltage in capacitors C1A and C2A to decay to a value low enough to permit SCR1A to turn OFF is a variable quantity depending on the voltage attained by timing capacitor C2A.

Figure 13:
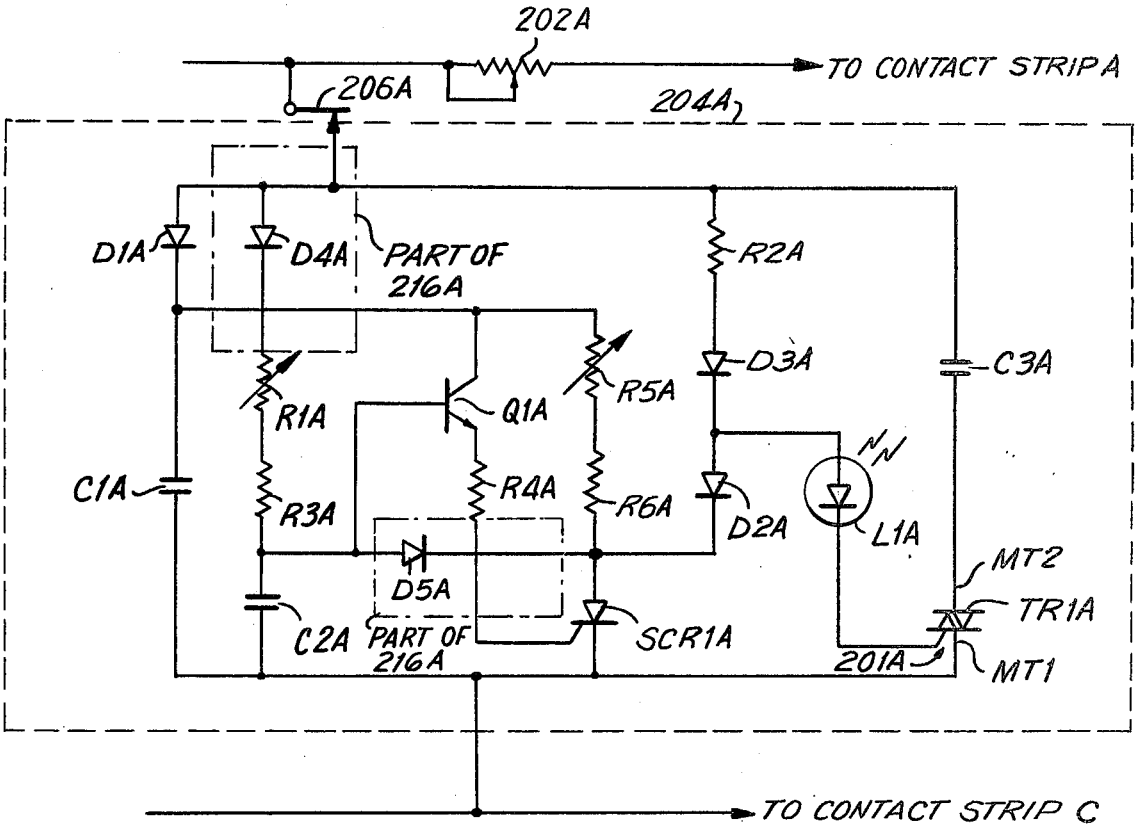
FIG. 13 is a detailed schematic diagram of an A boost circuit similar to FIGS. 7, 9 and 12 except including a timing stabilizing circuit.

In the preferred embodiment, shown in FIG. 13, a timing stabilizing circuit 216A provides a fixed delay period, suitably about 1.5 seconds, before an additional boost can be provided regardless the length of time during which a preceding boost was applied.

A second input diode D4A, forming part of timer stabilizing circuit 216A, directly feeds timing capacitor C2A through variable resistor R1A in series with resistor R3A. A discharge diode D5A, forming the other part of timer stabilizing circuit 216A has its anode terminal connected to timing capacitor C2A and its cathode terminal connected to the anode terminal of silicon controlled rectifier SCR1A.

As in the embodiment shown in FIG. 12, the embodiment shown in FIG. 13 holds silicon controlled rectifier SCR1A OFF and keeps triac TR1A ON until the voltage in timing capacitor C2A increases sufficiently to turn transistor Q1A ON. The resulting voltage applied through the collector-emitter circuit of transistor Q1A to the gate of silicon controlled rectifier SCR1A turns silicon controlled rectifier SCR1A ON. Timing capacitor C2A immediately discharges through SCR1A to hold the voltage in timing capacitor C2A at a fixed level.

When the positive pulses are removed from the input, smoothing capacitor C1A begins to discharge through variable resistor R5A, resistor R6A and SCR1A until the voltage in smoothing capacitor C1A falls to a value too low to maintain forward conduction in SCR1A. SCR1A then turns OFF and thereafter requires a gating signal to again turn ON. By discharging timing capacitor C2A through discharge diode D5A rather than adding its charge to that stored in smoothing capacitor C1A, the variability in reboost time occuring in the embodiment of FIG. 12 is eliminated. Variable resistor R5A adjusts the discharge time of smoothing capacitor C1A. A discharge time of about 1.5 seconds has been found to be satisfactory. If power is again applied while SCR1A remains conducting, no power boost is produced since conduction in SCR1A merely continues. In addition, smoothing capacitor C1A is again almost immediately fully recharged by the renewed positive pulses and thus forces another additional wait for the fixed time before another boost is available.

Accordingly, it is seen that a relatively simply constructed toy vehicle game is provided in which players have complete independent control over the speed of operation of the toy vehicles, including the ability to cause the toy vehicles to shift independently from one lane to the other and to use a time-limited power boost to pass each other or to pass a drone car moving along the track at a constant speed. This is achieved without the complexities of multiple element steering systems or solenoid bumper and steering arrangements. Moreover, it is accomplished with a simple change in polarity of the current flow to the toy vehicle's motor and not only eliminates the attendant loss of speed which occurs with previously proposed structures wherein lane changes are provided as a result of shutting off of power to the vehicle motor but also, in fact, provides an increase in speed much like the "passing gear" of full-sized vehicles.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A toy vehicle system comprising:

a track having at least first and second vehicle lanes;

at least one electrically driveable toy vehicle adapted for driving on said track;

control means for controlling the amplitude of electric power to said at least one electrically driveable toy vehicle and for selectively providing said electric power in either first or second polarity;

means for biasing said vehicle into said first vehicle lane in response to said first polarity and into said second vehicle lane in response to said second polarity; and boost means for boosting the maximum power available to said at least one electrically driveable toy vehicle for a predetermined maximum time after changing said electric power from said first to said second polarity.

2. A toy vehicle system according to claim 1; further comprising means in said boost means for preventing said boosting until a second predetermined time after changing said electric power from said second to said first polarity.

3. A toy vehicle system according to claim 1; wherein said control means includes:

a first half-wave rectifier operative to provide positive half cycles of electric power;

a second half-wave rectifier operative to provide negative half cycles of electric power;

switch means for selecting either said positive half cycles or said negative half cycles; and means for varying the amplitude of the selected half cycles.

4. A toy vehicle system according to claim 3; wherein said boost means includes a capacitor and a switch operative to connect said capacitor across said electric power.

5. A toy vehicle system according to claim 4; further comprising timer means in said boost means for opening said switch at said predetermined maximum time and for maintaining said switch open as long as said second polarity continues to be supplied and for a second predetermined time thereafter.

6. A toy vehicle system according to claim 5; wherein said switch is an electronic switch and said timer means is effective to control closing and opening thereof.

7. A toy vehicle system according to claim 4; wherein said switch is an electronic switch.

8. A toy vehicle system according to claim 7; wherein said electronic switch includes a triac.

9. A toy vehicle system according to claim 1; further comprising means for indicating when said boost means is operating.

10. A toy vehicle system according to claim 9; wherein said means for indicating is a light emitting diode which is illuminated when said boost means is operating.

11. A toy vehicle system according to claim 1; wherein said at least one electrically driveable toy vehicle includes first and second toy vehicles, said control means being effective for independently controlling the amplitude and polarity of said electric power to said first and second toy vehicles and further comprising balancing means for matching the maximum performance of said first and second toy vehicles whereby the outcome of a race therebetween is determined by the skill of the operators.

12. A toy vehicle system according to claim 1; wherein said at least one electrically driveable toy vehicle includes first and second toy vehicles, said control means includes a first half wave rectifier operative to provide positive half cycles of electric power and a second half wave rectifier operative to provide negative half cycles of electronic power, and said first toy vehicle being biased into said first vehicle lane by selective application of said positive half cycles and said second toy vehicle being biased into said first vehicle lane by selective application of said negative half cycles.

13. A toy vehicle system according to claim 1; wherein said boost means include:

a capacitor;

a switch operative to connect said capacitor across said electric power; and a timer responsive to said second polarity to close said switch for said predetermined maximum time and thereupon to open said switch.

14. A toy vehicle system according to claim 13; wherein said timer includes means for preventing said boosting until a second predetermined time after said first polarity is again applied to said toy vehicle.

15. A control system for a toy vehicle of the type which is biased in a first lateral direction by a voltage of a first polarity applied thereto and biased in a second lateral direction by a voltage of a second polarity applied thereto and which is driven in the forward direction at a speed determined by the amplitude of the voltage applied thereto comprising:

means for selectively applying half cycles of electric power of either said first or second polarity to said toy vehicle;

boost means operative to boost the maximum electric power applied to said toy vehicle for a first fixed maximum time following selectively changing from said first polarity to said second polarity applied to said toy vehicle; and timer means for preventing operation of said boost means as long as said second polarity is applied to said toy vehicle and for a second predetermined minimum time thereafter.

16. A control system according to claim 15; further comprising said timer means including means for controlling said second predetermined minimum time to a fixed predetermined time.

17. A control system according to claim 15; wherein said timer means includes means for preventing operation of said boost means when said second polarity is reapplied to said toy vehicle before the end of said second predetermined minimum time and for continuing to prevent operation of said boost means as long as said second polarity is applied to said toy vehicle and for said second predetermined minimum time thereafter.

18. A toy vehicle system comprising:

a track having at least first and second vehicle lanes;

a pair of electrically drivable toy vehicles adapted for driving on said track; said track having means for independently feeding electric power to said toy vehicles, including control means for independently controlling the amplitude of said electric power fed to said toy vehicles and for selectively providing said electric power in either first or second polarity;

means for biasing said vehicles into said first vehicle lane in response to a predetermined polarity of said electric power supplied thereto and into said second vehicle lane in response to the other of the polarities of electric power supplied thereto; and balancing means for equalizing the maximum performance of said first and second toy vehicles;

said balancing means including ganged means operative to simultaneously influence the maximum performance of said first and second toy vehicles in the opposite sense whereby said equalizing is performed with a single control manipulation; and said control means including first and second hand controllers having first and second operator controllable variable resistors therein for controlling said amplitude, said ganged means including a first balancing variable resistor in series with said first operator controllable variable resistor and a second balancing variable resistor in series with said second operator controllable variable resistor, said first and second balancing variable resistors being ganged whereby said single control manipulation is effective to reduce the resistance of one of said first and second balancing variable resistors and to simultaneously increase the resistance of the other thereof whereby the maximum speed of the better performing of said first and second toy vehicles is reduced and the maximum speed of the poorer performing thereof is increased to achieve substantially equal performance of said first and second toy vehicles.

19. A toy vehicle system according to claim 11; wherein said balancing means includes first and second ganged variable resistors effective to simultaneously increase the maximum performance of one of said first and second toy vehicles and decrease the maximum performance of the other thereof using a single control manipulation.

* * * * *